US005982263A

United States Patent [19]

Bouillot et al.

[11] Patent Number: 5,982,263

[45] Date of Patent: Nov. 9, 1999

[54] HIGHER FREQUENCY SWITCH MODE TRANSFORMER

[75] Inventors: Jean-Michel Bouillot, Velay; Thierry Coutureau, Scev; Hervé Faivre; Denis Larche, both of Gray, all of France

[73] Assignee: Thomson Television Components France, Boulogne, France

[21] Appl. No.: 08/976,350

[22] Filed: Nov. 21, 1997

[30] Foreign Application Priority Data

Dec. 9, 1996 [FR] France ..... 96 15111

[51] Int. Cl.[6] ..... H01F 27/30

[52] U.S. Cl. ..... 336/185; 336/82; 336/180; 336/198; 336/208

[58] Field of Search ..... 336/180, 185, 336/82, 173, 208, 198

[56] References Cited

U.S. PATENT DOCUMENTS 4,623,754 11/1986 Kikuchi et al. ..... 174/52 R

FOREIGN PATENT DOCUMENTS 0 028 383 5/1981 European Pat. Off. .
0 033 450 8/1981 European Pat. Off. .
0 071 008 2/1983 European Pat. Off. .
0 291 575 11/1988 European Pat. Off. .
0 609 155 8/1994 European Pat. Off. .

OTHER PUBLICATIONS

Kabushiki Kaisha Tamura Seisakusho; Demade De Brevet D'Invention; Mar. 9, 1973; pp. 1–9; 1 Drawing Sheet.

*Primary Examiner*—Lincoln Donovan
*Assistant Examiner*—Tuyen Nguyen
*Attorney, Agent, or Firm*—Joseph S. Tripoli; Joseph J. Laks; Daniel E. Sragow

[57] ABSTRACT

Transformer (1) for switched-mode power supply, equipped with a former (6) having chambers (9), each chamber (9) containing windings (15, 16), each winding (15, 16) having an outer side surface (18) generated by a straight line moving parallel to an axis (AA') of the former, and characterized in that the generatrices of all the outermost surfaces (18) of the windings (15, 16) contained in each of the chambers (9) are identically the same for all the outermost surfaces (18) of the windings (15, 16) of each of the chambers, these generatrices thus forming a unique cylindrical surface parallel to the axis (AA') of the former (6).

11 Claims, 5 Drawing Sheets

HIGHER FREQUENCY SWITCH MODE TRANSFORMER

FIELD OF THE INVENTION

The invention concerns the field of switched-mode power supply transformers.

It relates to an improvement to transformers of this type.

BACKGROUND

Switched-mode power supplies currently equip the majority of televisions and monitors which include a cathode-ray tube. These power supplies operate by chopping the current.

The principle of power supplies of this type is now well known. The article "IEE transaction on Consumer Electronics 473–479" explains the benefit and the working principle of power supplies of this type. These power supplies include a transformer having primary windings and secondary windings.

The invention relates to the architecture of the transformer. A known example of a transformer of this type for a switched-mode power supply is described in European Patent EP 71008, filed in the name of Licentia Patent Wervaltung.

This patent describes a transformer for a switched-mode power supply, in which the windings of the primary and of the secondary are not produced in successive layers around a ferromagnetic core, but in adjacent chambers arranged axially along the core. Each chamber is separated from the next by a sheet of insulating material. A transformer of this type is represented in FIG. 1 under the general reference 1.

It has a ferrite core 2 formed by two E-shaped ferrite half-cores 3, 4 which are bonded to one another by a line of adhesive 5 in order to form a right-angled torus with rectangular cross-section to which a central part, masked in FIG. 1 by a former 6, is adjoined; the former 6 is partially represented in FIG. 2. It has a cylindrically shaped hollow central core 7 and walls 8 perpendicular to this body. Only one of these walls 8 has been represented in FIG. 2. Windings (not shown) are present in chambers 9 formed between two walls. The wires 10, 10' of these windings are connected to connection pins 11, 11'. The primary windings are connected to the pins 11, and the secondary windings to the pins 11'. All the primary connection pins 11 are located on one side of the transformer. All the secondary connection pins 11' are located on the other side of the transformer. Because of the perspective represented in FIG. 1, only the primary winding wires 10 and the primary connection pins 11 are represented. The secondary connection wires 10' and the secondary connection pins 11' are all, for good isolation, located on a different side of the transformer. The wires 10' of the secondary are connected to the pins 11' of the secondary in a technical fashion similar to the connection of the wires 10 of the primary to the pins 11 of the primary. The term "other side of the transformer" means that the primary pins 11 and the secondary pins 11' lie on either side of a plane of symmetry of the core. In the case represented in FIG. 1, this is the plane of symmetry common to all three branches of the Es forming each half-core 3, 4 of the core 2.

The term "ends 12, 12'" of the primary wires 10 and secondary wires 10' is hereafter used to denote the portion of wire 10, 10' located between the end of a winding and a connection pin 11 or 11'. These ends are held in place by notches 13, 13' formed on one side of the insulating walls 8. The notches 13 or 13' of a wall 8 together form a connection comb 14 of the wall 8.

The combs 13 of the walls 8 guiding the primary wires 10 are located on the same side as the primary connection pins 11. The combs 13' of the walls 8 guiding the secondary wires 10' are located on the same side of the secondary connection pins 11'.

This transformer architecture permits good isolation of the primary side, also referred to as the "hot side", from the secondary side, also referred to as the "cold side". This good isolation is due to the fact that the primary and secondary windings are in chambers 9 which are DC isolated from one another by insulating walls 8 and to the fact that the primary pins 11 and secondary pins 11' are remote from one another.

The leakage inductances remain acceptable because chambers 9 containing primary windings and chambers 9' containing secondary windings have alternate axial positions, and there is a fairly large number of them. However, all other things being equal, this leakage inductance increases when the switching frequency increases.

ADVANTAGES OF THE INVENTION

The present invention relates to a transformer for a switch-mode power supply, of the type having chambers, as described, for example, in European Patent EP 71008 and having a small leakage inductance, and being easier to manufacture while taking into account the diverse needs of the users of these transformers, all this while keeping the quality of isolation inherent in chamber-type transformers.

This object is achieved according to the invention by producing the former in accordance with the windings which it is to contain. This point is specified below:

It has been seen that the former consists of an insulating material. It includes a hollow cylinder 7. The interior of this cylinder 7 contains a part of the magnetic circuit of the transformer. The windings constituting the primary or the secondary are produced around this cylinder. The external diameter of this cylinder constitutes the internal diameter of each of the partial windings which lie closest to this cylinder. The external diameter of a partial winding is the largest diameter of this winding. If a second partial winding is produced in a chamber where a first winding has already been produced, the internal diameter of this second winding is equal to the external diameter of the first winding, and its external diameter is the greatest diameter of this secondary winding. According to the invention, the external diameters of the outer most windings contained in each of the chambers of the former are equal. It should be noted that use of the term "diameter" presupposes that the cylinder 7 is a cylinder of revolution, that is to say a cylinder whose cross-section consists of a circle. In the more general case, it may be an arbitrary cylinder, that is to say the volume generated by a straight line which moves parallel to itself while touching a directrix curve. It may, for example, be a cylinder with rectangular or elliptical cross-section. In this general case of embodying the invention, the outer side surfaces of the outermost windings contained in each of the chambers are all in coincidence with the same cylindrical surface, this cylindrical surface being parallel to the cylindrical surface of the former receiving the innermost windings.

SUMMARY OF THE INVENTION

In summary, in its most general form, the invention relates to a transformer for switched-mode power supply, equipped with a former having a cylindrical part of axis AA' and separating walls secant to the axis AA', the volumes delimited by two axially consecutive separating walls and the outer side surface of the cylindrical part constituting chambers of the former, each chamber containing at least one winding of conductive wire, each winding having two side surfaces, an inner side surface which is closest to the outer side surface of the cylindrical part of the former, and an outer side surface which is the outer surface of this winding furthest from the outer side surface of the former, one of the outer surfaces of the windings of each of the chambers constituting the outermost surface of the windings of each of the chambers all coincide with the same cylindrical surface parallel to the outer side surface of the former.

A configuration of this type is distinguished from the prior art in that, in the chamber-type transformers for a switched-mode power supply of the prior art, the separating walls delimit chambers whose axial lengths are all equal to one another. According to the invention, these axial lengths can vary from one chamber to another, so that different numbers of turns of windings inside each chamber constitute windings whose outermost side surfaces are in coincidence with a unique cylindrical surface parallel to the cylindrical surface of the former. An embodiment according to the invention contributes to reducing the leakage inductances. Another measure further contributes to reducing these leaks. This involves placing the primary windings in parallel with one another, on the one hand, and the secondary windings in parallel with one another, on the other hand. Each winding part, for example primary winding part contributing to a primary parallel winding, is placed in a primary chamber. This primary chamber is adjacent to a secondary chamber which itself contains a winding part constituting, with other secondary windings, a secondary parallel winding. This parallel winding architecture contributes not only to reducing the ohmic resistance of the windings, which is known, but also to reducing inductive losses by increasing the area of the facing surfaces of primary and secondary windings. The term "facing surfaces" means the winding surfaces which are parallel to the separating walls. The surfaces are referred to as "facing" when they lie on either side of the same separating wall.

BRIEF DESCRIPTION OF THE DRAWINGS

The most general embodiment of the invention, the preferred embodiment and variants of the latter will now be described with reference to the appended drawings, in which:

In all the figures, the elements which fulfil the same functions have the same reference numbers.

FIG. 3 represents an axial half-section of a former 6 bearing primary windings 15 housed in chambers 9 of the former 6, and secondary windings 16 housed in chambers 9' of the former 6. The chambers 9 and 9' are alternate in order to provide good coupling. The volume of each chamber is delimited by a surface 17 belonging to the hollow tube 7 of axis AA' of the former 6 and by walls 8 perpendicular to the axis AA'. In the example which is represented, there are three chambers 9 containing primary windings and three chambers 9' containing secondary windings. All the chambers have the same volume because the axial spacings of two consecutive walls are equal to one another. The primary chambers have been referenced 9-1, 9-2, 9-3. The secondary chambers have been referenced 9'-4, 9'-5, 9'-6.

The chamber 9-1 contains a part 15*a* of a working primary winding, the chamber 9-2 contains another part 15*b* of the same winding, and the chamber 9-3 contains a last part 15*c* of the same winding. The windings 15*a*, 15*b*, 15*c* are mounted in series, and are connected at pins 11, for example by welding. Other primary windings, one 15*e* for control, and the other 15*d* for feedback, are housed in the chamber 9-2.

The chamber 9-2 thus contains three windings or winding parts produced one above the other. A second winding is referred to as being above a first winding when the internal diameter of the second winding is equal to the external diameter of the first winding.

Figure 3:
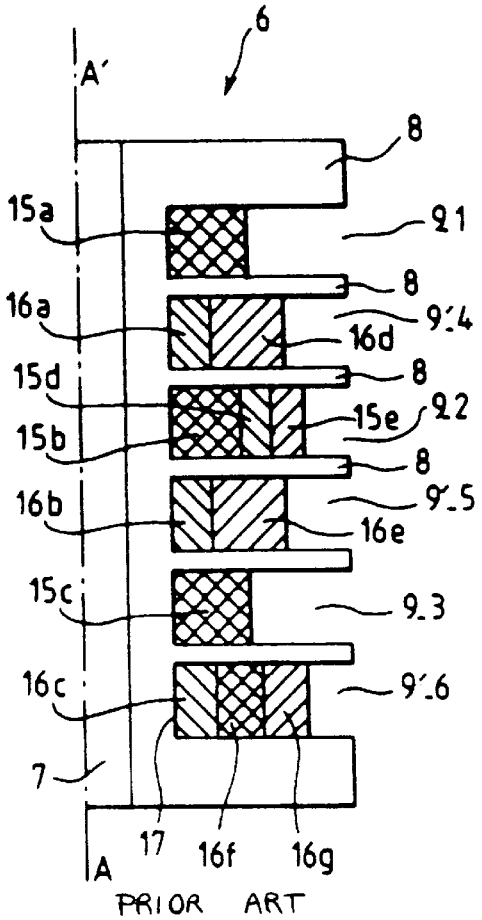
FIG. 3 represents an axial half-section of a former and of the windings which it contains, equipping a prior art transformer.

The secondary chambers respectively contain windings 16*a* in the chamber 9'-4, 16*b* in the chamber 9'-5 and 16*c* in the chamber 9'-6. These three first windings of the secondary are connected in parallel, and are also connected at pins 11' of the secondary, for example by welding. Winding parts 16*d*, 16*e* and 16*f* connected in series are housed above the windings 16*a*, 16*b*, 16*c* respectively. Finally, a winding 16*g* is housed above the winding 16*f* in the chamber 9'-6. In general, the primary and secondary windings consist of winding parts housed in various chambers and connected in series or in parallel as required. Architectures of this type have the purpose of optimizing the primary-secondary coupling, reducing the ohmic losses, obtaining the various required voltages at the secondary, and the assembly is dimensioned in accordance with the cooling means in order to obtain an acceptable operating temperature. The numbers of turns of the windings at the primary and the secondary are chosen in order to obtain the desired voltages at the secondary while minimizing the ohmic losses (copper losses) and the magnetic losses or leaks (core losses). On the basis of calculations and trials which are carried out, transformers which, for example, have the technical characteristics of the transformer represented in FIG. 3 are constructed, in which the windings are produced as indicated above. On the example which is represented, it can be seen that the various external diameters of the windings or winding parts lying furthest outward are unequal, so that the side surface of these windings has a crenalated appearance. This is due to the fact that the chambers 9 have equal volumes. Similarly, the diameters of the wires have been chosen principally because of their ohmic characteristics, the considerations relating to the volumes occupied by the windings being involved only so that the transformers obtained are not too bulky and too heavy.

According to the invention, in order to minimize the magnetic losses and consequently the ohmic losses, the chambers are produced, the diameters of the wires are chosen, and the numbers of windings are chosen not only on the basis of the considerations already mentioned in the description of the prior art as represented in FIG. 3, but also by adding an additional parameter consisting of the external diameter of the outermost winding of each chamber. According to the invention, the outermost diameters of each chamber are equal to one another.

Figure 4:
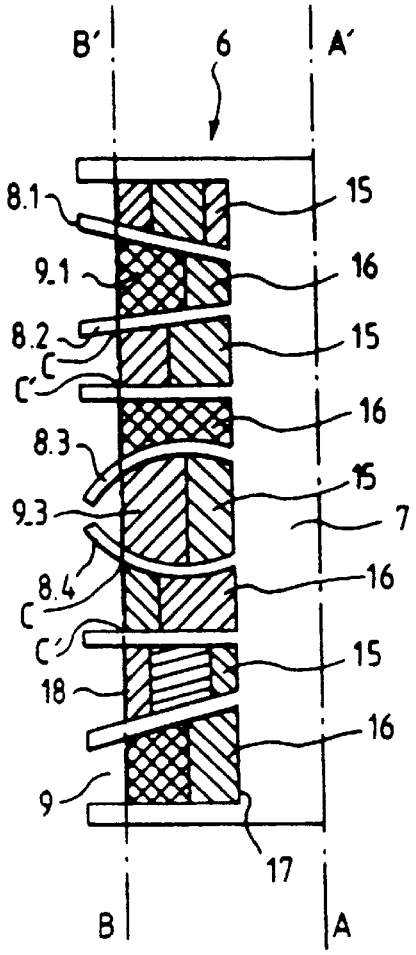
FIG. 4 represents a schematic axial half-section of a former and the windings which it contains, for a transformer according to the invention in its most general embodiment.

A hypothetical embodiment of the invention is represented in FIG. 4.

This figure represents a half-section on an axial plane of a former 6 provided with primary windings or winding parts 15 and secondary windings 16.

In this hypothetical example, the shapes and volumes of the chambers 9 consisting of separating walls 8 secant to the boundary surface 17 of a central cylinder 8 have shapes and volumes which are not necessarily similar or equal. Walls 8-1, 8-2 not perpendicular to the axis AA' defining a chamber 9-1, each cross-section of which on an axial plane has a trapezoidal shape, have intentionally been represented in this hypothetical example. Walls 8-3, 8-4 secant to the boundary 17, each cross-section of which on an axial plane is curved, have also been represented. With the boundary 17, these walls define a chamber 9-3 of which each cross-section on an axial plane has the shape represented in FIG. 4.

In each chamber 9, the section of the outermost surface 18 of the windings which are contained therein is a straight-line segment CC'. Each straight-line segment CC' of each of the chambers 9 belongs to the same straight line BB' parallel to the axis AA' of the central part 7 of the former 6. The same is true as regards each of the sections of the former on an axial plane. In order to obtain this result, the person skilled in the art can vary parameters such as:

the shape of each chamber, the diameter of the wires constituting the various windings, the addition of windings connected in parallel to first windings.

These considerations will arise after defining, in known fashion, the numbers of turns of the windings and their distribution in the various chambers.

In the most common cases, importance will also be attached to the cost of producing the equipment for manufacturing the formers.

A preferred embodiment of a transformer according to the invention will now be described with reference to FIGS. 5 to 9.

Figure 1:
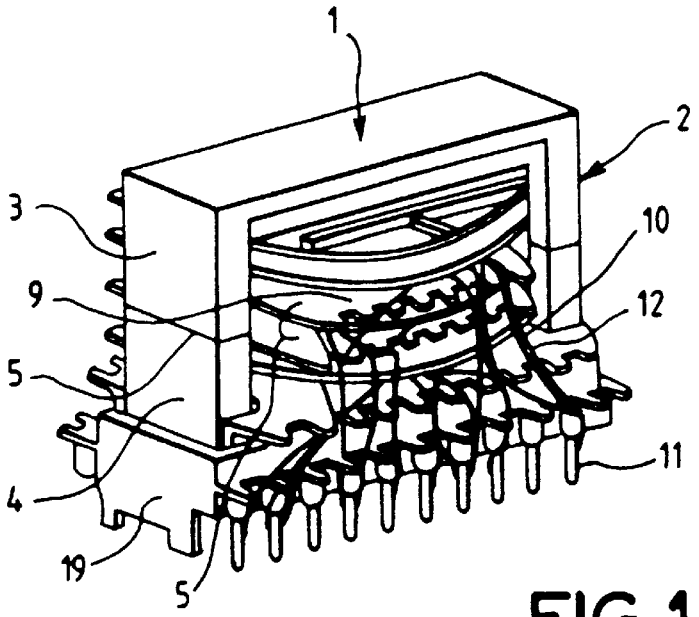
FIG. 1, already discussed, represents a perspective view of a known transformer.
Figure 2:
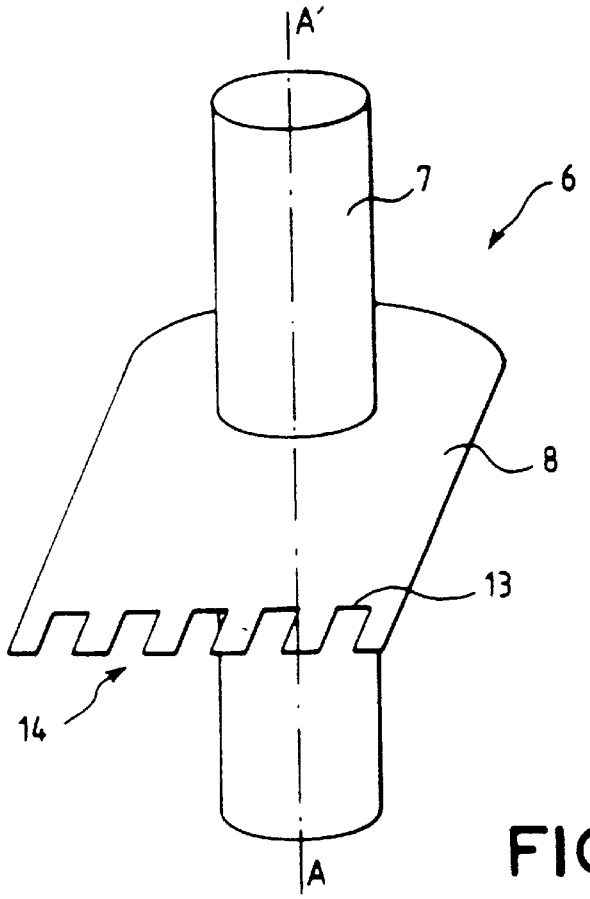
FIG. 2, already discussed, represents a perspective view of a part of a former. In this part, only one of the chamber walls has been represented.
Figure 5:
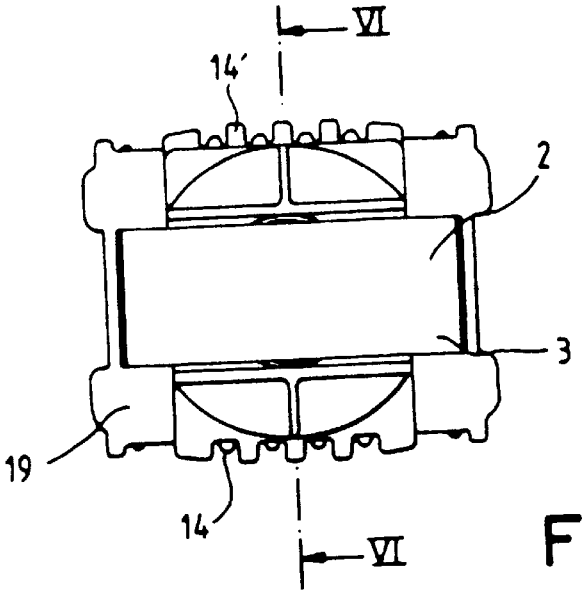
FIG. 5 represents a plan view of a transformer according to the invention.

FIG. 5 represents a plan view of a transformer according to the invention. This transformer has the general shape of the one represented in FIG. 1. The top of the transformer is the side opposite the connection pins 11, 11'.

Figure 6:
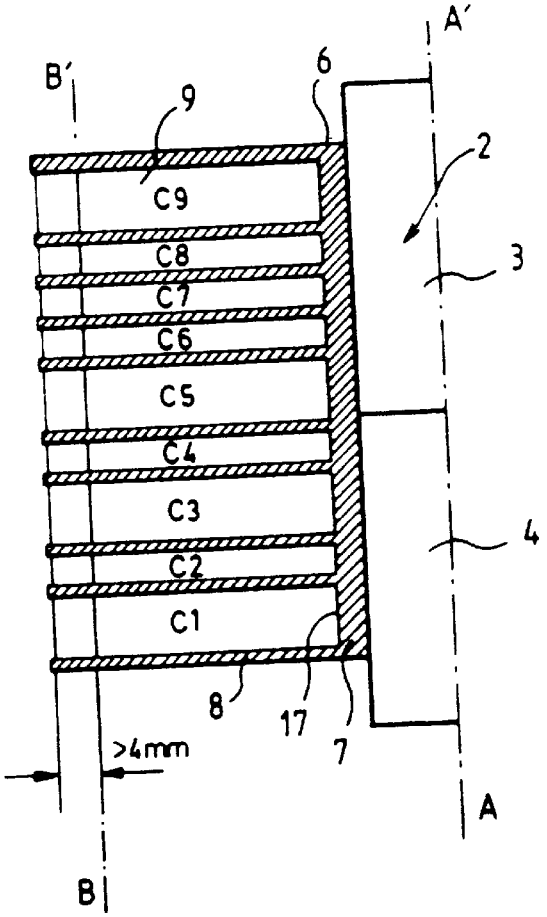
FIG. 6 represents an axial half-section on the line 6—6 in FIG. 5.
Figure 8:
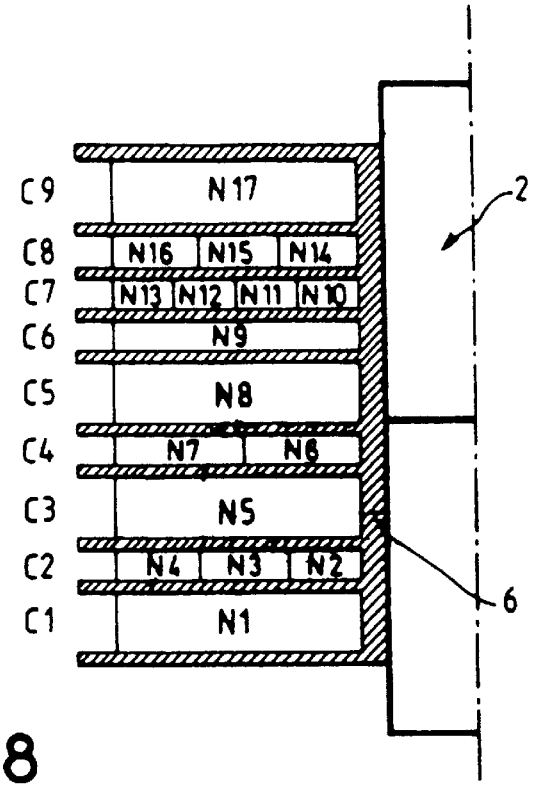
FIG. 8 schematically represents the physical locations of the windings represented in FIG. 7 in the chambers of the former represented in FIG. 6.

FIG. 5 shows the top of the core 2, parts of the former 6 and, in particular, a lower part 19 of this former which bears the pins 11, and comb parts 14, 14' of the primary side and of the secondary side. FIGS. 6 and 8 are enlarged half-sections on VI—VI of the transformer represented in FIG. 5.

For the sake of clarity, the windings are not shown in FIG. 6.

FIG. 6 shows the former 6 and that part of the core 2 which is housed in the central part 7 of the former 6.

Walls 8 perpendicular to the axis AA' of the central part 7 delimit, with the surface 17 of this central part, chambers 9 intended to house the windings. The central part 7 is a cylinder of revolution. The outermost surface of each of the windings housed inside each chamber, and the entirety of the windings contained in the various chambers, is a cylindrical surface of revolution in this embodiment. The external diameters of the outermost windings of each of the chambers are all equal to one another.

It can be seen that the heights of the chambers, that is to say the separation distance, measured parallel to the axis AA', between two consecutive walls are not necessarily equal to one another.

In the case when the wires constituting the windings have the same diameter, then the height of the chambers is inversely proportional to the number of turns of the windings contained in each chamber.

In the case when the number of turns of the windings is the same, but when the diameter of the wires is different, then the height of the chambers is proportional to the square of the diameter of the wires which are contained therein. Naturally, the calculations given above are possible only if the height of the chambers is large compared with the diameter of the wires which are housed therein.

The chambers 9 of the transformer in FIG. 6 have been numbered C1 to C9. For each chamber, the following table gives the number of turns of the windings which are contained therein and the diameters of the wires which are used.

| CHAMBERS | NUMBER OF TURNS | Ø WIRES M |
|---|---|---|
| C9 | 83 | 0.2 |
| C8 | 47 | 0.2 |
| C7 | 16 | 0.315 |
| C6 | 44 | 0.2 |
| C5 | 95 | 0.2 |
| C4 | 16 | 0.315 |
| C3 | 89 | 0.2 |
| C2 | 47 | 0.2 |
| C1 | 83 | 0.2 |

In the example which is represented, each chamber contains only wires having the same diameter, in order to simplify manufacture. If a chamber contains a plurality of windings, it is naturally possible for these windings to use wires of different diameter.

Figure 7:
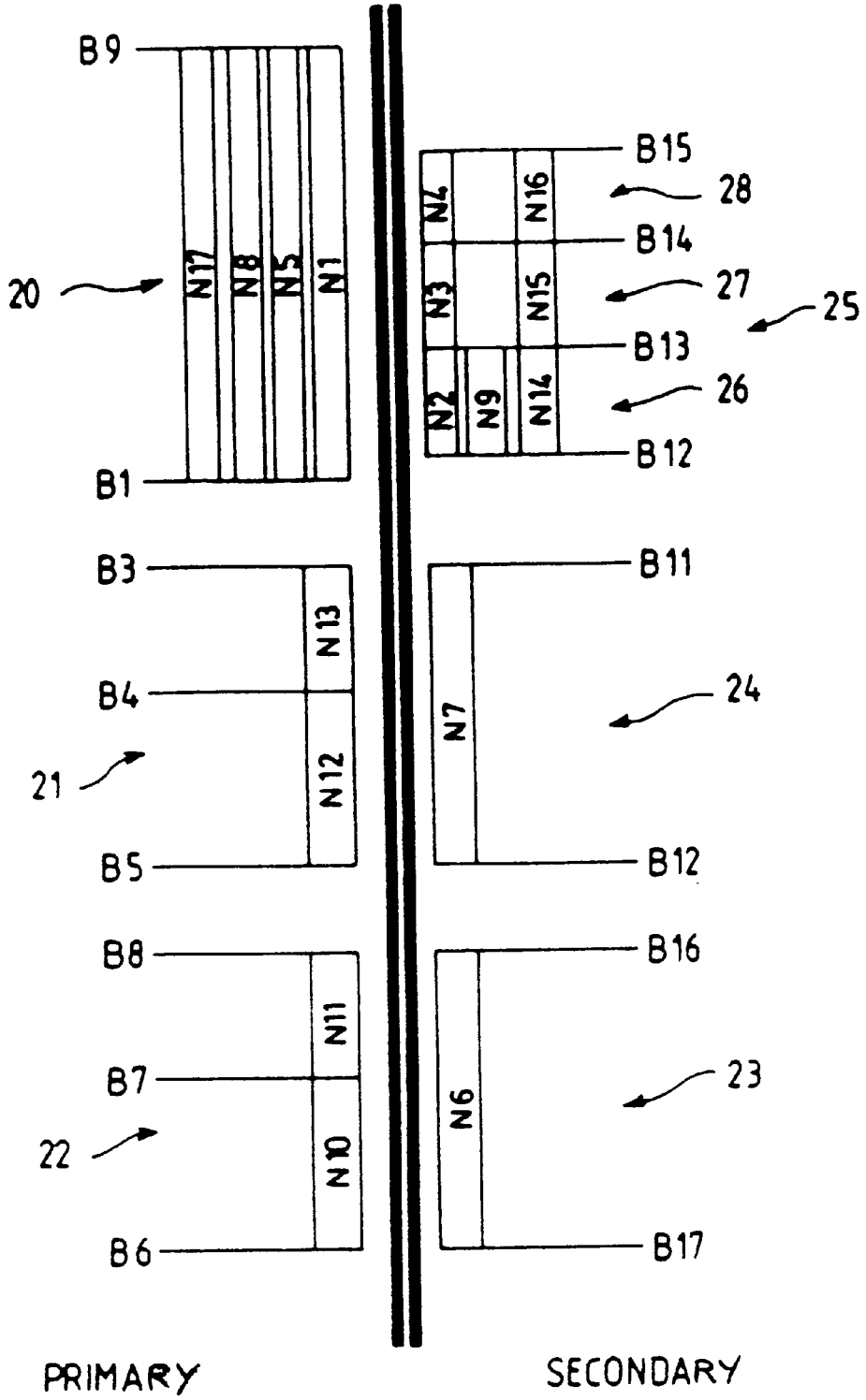
FIG. 7 schematically represents the connection modes for the windings of the primary and of the secondary of a preferred embodiment of a transformer according to the invention.

For each primary and secondary winding, FIGS. 7 and 8 represent its connection mode (parallel or series) and its location inside each of the chambers 9.

The primary side of the transformer represented on the left-hand part of FIG. 7 has three groups of windings.

A first group of windings 20 includes 4 windings connected in parallel between pins 10 on the primary side. There are 9 pins indexed B1 to B9. The 4 windings of the group 20 are indexed N1, N5, N8 and N17.

A second group of windings 21, which includes two windings connected in series and meeting one another on the terminal 10 indexed B4, is connected between the terminals 10 indexed B3 and B5. The windings of this second group are indexed N12 and N13.

Finally, the third group of primary windings 22, which is composed of two windings indexed N10 and N11 connected in series at the terminal 10 indexed B7, is connected between the terminals 10 B6, B8.

The secondary side represented on the right-hand part of the FIG. 7 also has three groups of windings.

A first group 23 includes only one winding referenced N6, connected between the secondary terminals 11' referenced B16 and B17.

A second group 24 includes only one winding referenced N7, connected between the secondary terminals 11' referenced B11 and B12.

Finally, a third group 25 includes three sub-groups of windings connected in series.

A first sub-group 26 includes three windings connected in parallel between the terminals 11' indexed B12, B13. These three windings are indexed N2, N9 and N14.

A second sub-group 27 includes two parallel windings which are indexed N3, N15 and are connected between the terminals indexed B13, B14.

Finally, the third sub-group 28 includes two parallel windings which are indexed N4, N16 and are connected between the terminals indexed B14, B15.

The various windings are housed, as represented in FIG. 8, by winding index number increasing from a chamber indexed C1 to a chamber indexed C9. The primary windings are housed in the chambers 9 indexed C1, C3, C5, C7 and C9.

Each of the windings N1, N5, N8, N17 which are connected in parallel and form the group 20 is housed on its own in the chambers C1, C3, C5 and C9 respectively.

The groups of windings of the secondary are housed in the chambers 9' indexed C2, C4, C6 and C8. It can thus be seen that the even-index chambers of the secondary are alternated with odd-index chambers containing primary windings. With the exception of the extreme chambers C1 and C9, a chamber containing primary windings is adjacent to two chambers containing secondary windings. In the example which is represented, where the extreme chambers C1 and C9 are chambers containing primary windings, each of the chambers containing secondary windings is adjacent to two chambers containing primary windings.

The group of secondary windings 23 including the winding N6 is housed in the chamber C4. The group of windings 24 including the winding N7 is housed with the winding N6 of the group 23 in the same chamber C4. The chamber C4 includes only the windings N6 and N7. The windings of the group of secondary windings 25 have their windings housed in the secondary chambers indexed C2, C6 and C8.

The series windings N2, N3 and N4 of the sub-groups 26, 27, and 28 are housed in the chamber 9' indexed C2, which contains no other windings. Finally, the winding N9 of the sub-group 26 is housed alone in the chamber C4.

The numbers of turns of the windings in parallel N2, N9 and N14 are respectively 41, 44 and 41. These numbers are adjusted so as to obtain currents of the same value in each of these three windings in parallel. These adjustments are made when producing the prototypes so as to equalize the ohmic losses and therefore the temperatures in each of these three windings. The same is done for the two windings in parallel N3, N4, on the one hand, and N15, N16 on the other hand. The result achieved by this is to distribute the ohmic losses in each of the chambers C2, C6 and C8 and therefore to minimize the maximum temperature obtained in the chamber.

Similarly, at the primary, the number of turns of each of the windings in parallel N1, N5, N8, N17 are adjusted in order to obtain equal currents in each of the windings and therefore equal ohmic losses in each of the chambers C1, C3, C5 and C9. The maximum temperature obtained in a chamber is thus minimized.

The fact that each of the primary windings N1, N5, N8, N17 connected in parallel is in a chamber adjacent on one side at least to a chamber which itself contains a secondary winding, forming part of a set of secondary windings connected in parallel, contributes to increasing the areas of the facing surfaces of primary and secondary windings. This increasing the area of the facing surfaces increases the coupling between the primary and secondary and therefore contributes to reducing the leakage inductance. When fitted to the control chassis of a cathode-ray tube, a transformer according to the invention thus contributes to reducing the parasitic signals which risk distorting the image formed on this tube.

In an advantageous embodiment, at least of the separating walls between two chambers containing windings or winding parts is equipped with two combs for holding the ends of windings. The difference between a separating wall according to this embodiment of the invention and a wall of the prior art is represented by FIGS. 9 and 10.

Figure 9:
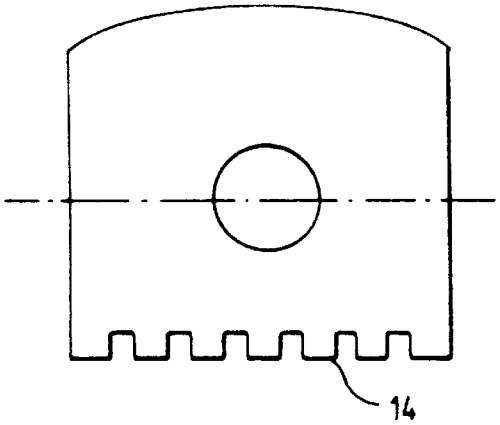
PRIOR ART FIG.9
FIG. 9 represents a plan view of one of the separating walls according to the prior art.
Figure 10:
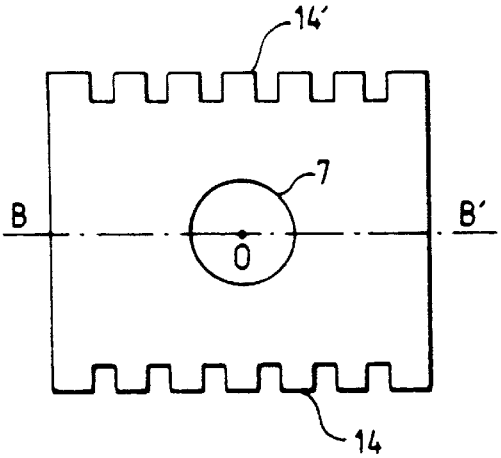
FIG. 10 represents a plan view of at least one of the separating walls of a former of a transformer according to the invention.

FIG. 9 represents a plan view of a separating wall 8 according to the prior art. This substantially rectangular wall is equipped with a comb 14 on one of its sides. This comb is used to hold the extremities 12 of the windings, from the end of the winding to a connection pin 11. This comb is located on the primary side or on the secondary side depending on whether the windings located in the chamber 9, which is itself located immediately above this wall, are primary or secondary windings. According to the embodiment of the invention, at least one of the walls 8 is provided with two combs, one 14 on the side of the primary and the other 14' on the side of the secondary.

Each of the combs is in a position substantially symmetrical with the position of the other with respect to a median axis of the wall. The term "median axis" means an axis which is parallel or perpendicular to the plane of the wall and passes through a point of symmetry of the wall or equidistant from two opposite edges of the wall. In the example represented in FIG. 10, the axis BB' passing through the point 0 which is the centre of the tube 7, contained in the plane of symmetry of the core 2 and in the plane of the wall, is a median axis. An axis which passes through 0 and is perpendicular to the plane of the wall is also a median axis.

The chamber 9 located immediately above this wall may equally well be a chamber containing primary windings or secondary windings. It is known that a power supply can be controlled on the primary side or the secondary side. Thus, according to this embodiment, the location of the chamber containing the control windings is predetermined when moulding the former, but the choice of the control side can be determined when the windings are produced, according to the client's requirements. This affords a greater flexibility in production.

We claim:

1. Chamber transformer for switched-mode power supply, equipped with a former having a cylindrical part of axis AA' and separating walls secant to the axis AA', the volumes defined by two axially consecutive separating walls and an outer side surface of the cylindrical part constituting chambers of the former, each chamber containing at least one primary or secondary winding of conductive wire, each winding having two side surfaces, an inner side surface which is closest to the outer side surface of the cylindrical part of the former, one of the inner side surfaces of the windings of each of the chambers constituting an innermost surface of the windings of this chamber, said innermost surface coinciding with an outer side surface of the former, and an outer side surface of the winding furthest from the outerside surface of the former, one of the outer surfaces of the windings of each of the chambers constituting the outermost surface of the windings of a chamber, the outermost surfaces of the windings of each of the chambers all coincide with a cylindrical surface parallel to the outer side surface of the former, and at least one of the primary windings consists of at least three partial windings connected in parallel, each of the partial windings being isolated in a respective chamber, each respective chamber containing a primary partial winding being adjacent to a chamber containing a secondary winding.

2. Transformer according to claim 1, characterized in that a primary winding consists of four partial windings connected in parallel, each partial winding being isolated in a chamber.

3. Transformer according to claim 1, characterized in that a secondary winding consists of at least two partial windings in parallel, each of the partial secondary windings being housed in a chamber adjacent on one side at least to a chamber containing a winding of the primary.

4. Transformer according to claim 3, characterized in that one of the secondary windings comprises three partial windings connected in parallel.

5. Transformer according to claim 1, characterized in that each of the partial primary windings connected in parallel has a number of turns such that the currents flowing in each of these partial windings are substantially equal.

6. Transformer according to claim 3, characterized in that each of the partial secondary windings connected in parallel has a number of turns such that the currents flowing in each of these partial windings are substantially equal.

7. Transformer according to claim 1, characterized in that a secondary winding consists of at least two partial windings in parallel, each of the partial windings being housed in a chamber adjacent on one side at least to a chamber containing a winding of the primary.

8. Transformer according to claim 7, characterized in that each of the partial primary windings connected in parallel has a number of turns such that currents flowing in each of these partial windings are substantially equal.

9. Transformer according to claim 7, characterized in that each of the partial secondary windings connected in parallel has a number of turns such that currents flowing in each of these partial windings are substantially equal.

10. Transformer according to claim 8, characterized in that a primary winding includes four partial windings connected in parallel, and in that one of the secondary windings comprises three partial windings connected in parallel, the partial windings of said one of the secondary windings each being housed in chambers adjacent to two chambers containing primary windings.

11. Transformer according to claim 1 characterized in that at least one of the separating walls includes two combs, one of the combs serving to guide wires coupled to the primary winding, and the other serving to guide wires coupled to the secondary winding.

* * * * *